US009293866B2

(12) United States Patent
Tanaka et al.

(10) Patent No.: US 9,293,866 B2
(45) Date of Patent: Mar. 22, 2016

(54) CONNECTOR WITH U-SHAPED TERMINAL FITTINGS INSERT MOLDED IN A TUBULAR SHAPED HOUSING

(71) Applicant: Yazaki Corporation, Tokyo (JP)

(72) Inventors: Masahiro Tanaka, Kakegawa (JP); Hajime Kato, Kakegawa (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/277,460

(22) Filed: May 14, 2014

(65) Prior Publication Data

US 2014/0248800 A1 Sep. 4, 2014

Related U.S. Application Data

(63) Continuation of application No. PCT/JP2012/084299, filed on Dec. 27, 2012.

(30) Foreign Application Priority Data

Dec. 28, 2011 (JP) ..... 2011-288959

(51) Int. Cl.
*H01R 13/40* (2006.01)
*H01R 13/648* (2006.01)
(Continued)

(52) U.S. Cl.
CPC ..... *H01R 13/648* (2013.01); *H01R 12/777* (2013.01); *H01R 13/405* (2013.01); *H01R 13/447* (2013.01); *H01R 13/6581* (2013.01); *H01R 43/24* (2013.01)

(58) Field of Classification Search
CPC .... H01R 13/52; H01R 13/648; H01R 13/658; H01R 13/6581
USPC ..... 439/271–275, 587, 607.01–607.59
See application file for complete search history.

(56) References Cited

U.S. PATENT DOCUMENTS 5,766,039 A * 6/1998 Abe ..... 439/587
6,695,621 B1 * 2/2004 Wang ..... 439/35
(Continued)

FOREIGN PATENT DOCUMENTS

JP 5-33484 U 4/1993
JP 2007-234561 A 9/2007
(Continued)

OTHER PUBLICATIONS

International Search Report dated Apr. 29, 2013 issued in International Application No. PCT/JP2012/084299 (PCT/ISA/210).
(Continued)

*Primary Examiner* — Chandrika Prasad
(74) *Attorney, Agent, or Firm* — Sughrue Mion, PLLC

(57) ABSTRACT

A connector includes: a connector housing formed in a tubular shape by an insulating synthetic resin; a cover for closing an opening of one end side in an axial direction of the connector housing; and plural terminal fittings formed inside the connector housing by insert molding, one end of the terminal fittings each being arranged in an opening for coupling of the other end side in the axial direction of the connector housing and the other end of the terminal fittings each being connected to one end of an electric wire. The one end of the terminal fittings each led out of one inner wall part of the connector housing traverses the opening for coupling, and a distal end of the terminal fittings each is buried in the other inner wall part opposed to the one inner wall part.

4 Claims, 5 Drawing Sheets

(51) Int. Cl.

| | |
|---|---|
| ***H01R 12/77*** | (2011.01) |
| ***H01R 13/405*** | (2006.01) |
| ***H01R 13/447*** | (2006.01) |
| *H01R 13/6581* | (2011.01) |
| *H01R 43/24* | (2006.01) |

(56) References Cited

U.S. PATENT DOCUMENTS

| | | | | |
|---|---|---|---|---|
| 6,932,640 | B1 * | 8/2005 | Sung | 439/405 |
| 8,961,230 | B2 * | 2/2015 | Chou | 439/607.27 |
| 2007/0207652 | A1 | 9/2007 | Tsuruta | |
| 2009/0029594 | A1 | 1/2009 | Matsuoka | |
| 2009/0280684 | A1 * | 11/2009 | Sogo et al. | 439/607.01 |
| 2011/0021076 | A1 | 1/2011 | Sawada | |
| 2011/0256764 | A1 * | 10/2011 | Wu | 439/607.01 |
| 2012/0028509 | A1 | 2/2012 | Aoki | |

FOREIGN PATENT DOCUMENTS

| | | | |
|---|---|---|---|
| JP | 2009-272132 | A | 11/2009 |
| JP | 2011-28853 | A | 2/2011 |
| JP | 2011-28969 | A | 2/2011 |
| JP | 2011-124062 | A | 6/2011 |
| WO | 2011/010523 | A1 | 1/2011 |

OTHER PUBLICATIONS

Written Opinion dated Apr. 29, 2013 issued in International Application No. PCT/JP2012/084299 (PCT/ISA/237).

Communication issued on Jul. 7, 2015 by the Japanese Patent Office in related Application No. 2011-288959.

Office Action issued Nov. 5, 2015, issued by the State Intellectual Property Office of the People's Republic of China in counterpart Chinese Patent Application No. 201280061968.4.

Communication dated Jan. 19, 2016 from the Japanese Patent Office in counterpart application No. 2011-288959.

Office Action issued Jan. 21, 2016 by the European Patent Office in counterpart application No. 12 821 194.3-1801.

* cited by examiner

CONNECTOR WITH U-SHAPED TERMINAL FITTINGS INSERT MOLDED IN A TUBULAR SHAPED HOUSING

CROSS REFERENCE TO RELATED APPLICATIONS

This application is a continuation of PCT application No. PCT/JP2012/084299, which was filed on Dec. 27, 2012 based on Japanese Patent Application (No. 2011-288959) filed on Dec. 28, 2011, the contents of which are incorporated herein by reference.

BACKGROUND OF THE INVENTION

1. Field of the Invention

The present invention relates to a connector.

2. Description of the Related Art

For example, in an electric vehicle, an inverter for converting DC electric power from a battery into AC electric power and supplying the AC electric power is connected to a three-phase AC motor. In order to connect the inverter to the motor, a connector attachment structure in which a shield connector connected to the motor through an electric wire is attached to a shield case of the inverter is known (for example, see Patent Reference 1).

This kind of connector attachment structure includes a structure using an electric wire 501 with a shield connector shown in FIGS. 4 to 6. In the electric wire 501 with the shield connector, a pair of upper side connectors (connectors) 505 is attached to one end of an electric wire 503 and a lower side connector 507 is attached to the other end of the electric wire 503 as shown in FIG. 4.

As shown in FIGS. 5 and 6, the upper side connector 505 includes a tubular upper side housing (a connector housing) 509 with substantially an elliptic cross section, a cover 511 for closing an opening of the back side of the upper side housing 509, packing 515 which is a sealing member mounted on an outer peripheral surface 513 of the upper side housing 509, plural bus bars (terminal fittings) 517 in which one ends are arranged inside the upper side housing 509 and the other ends are respectively connected to conductors of the plural electric wires 503, and an upper side shield shell 519 with which the outside of the upper side housing 509 is covered.

The outsides of the electric wires 503 connected to the respective bus bars 517 are collectively covered with a braid (a metal mesh) 521 as shown in FIG. 4. The braid 521 is connected to the upper side shield shell 519 of the upper side connector 505 and a lower side shield shell 525 with which a lower side housing 523 of the lower side connector 507 is covered.

As shown in FIG. 6, in the bus bar 517, one end arranged inside the upper side housing 509 forms a free end bent in an L shape so as to be orthogonal to a fitting direction of the connector and is erected, and a fastening hole 527 into which a bolt 540 for making connection to the other terminal (not shown) is inserted is bored in this free end. The upper side housing 509 is inwardly provided with space 529 for bus bar fastening. When a fitting part of the other connector (not shown) is externally inserted into the outside of the upper side housing 509 of the upper side connector 505, a gap between the upper side housing 509 and the fitting part of the other connector is watertightly sealed with the packing 515 constructing a sealing part 531.

CITATION LIST

Patent Literature

[PTL 1] Japanese Patent Publication No. JP-A-2011-124062

However, the upper side housing 509 of the upper side connector 505 described above is formed in a flat tubular shape with a relatively large diameter since the plural bus bars 517 connected to the other terminal are inwardly arranged in parallel and also the space 529 for bus bar fastening is formed.

Hence, the upper side housing 509 may be inwardly deformed (inwardly fallen) by being pressed through the packing 515 when the fitting part of the other connector is fitted into the outside. Also, at the time of molding of the upper side housing 509, an inward fall due to contraction of a molded resin may occur to adversely affect the sealing part 531.

SUMMARY OF THE INVENTION

The invention has been implemented in view of the circumstances described above, and an object of the invention is to provide a good connector capable of preventing an inward fall of a connector housing formed in a tubular shape.

The object according to the invention is achieved by the following configurations.

(1) A connector comprising: a connector housing formed in a tubular shape by an insulating synthetic resin; a cover for closing an opening of one end side in an axial direction of the connector housing; and plural terminal fittings formed inside the connector housing by insert molding, one end of the terminal fittings each being arranged in an opening for coupling of the other end side in the axial direction of the connector housing and the other end of the terminal fittings each being connected to one end of an electric wire, wherein the one end of the terminal fittings each led out of one inner wall part of the connector housing traverses the opening for coupling, and a distal end of the terminal fittings each is buried in the other inner wall part opposed to the one inner wall part.

According to the connector with the configuration of the above (1), one inner wall part and the other inner wall part facing each other across the opening for coupling of the connector housing are joined and fixed by one end of the terminal fitting, so that an inward fall of the connector housing can be prevented. Also, one end of the terminal fitting connected to the other terminal is in a support state of both ends supported by one inner wall part and the other inner wall part facing each other across the opening for coupling, so that strength of connection to the other terminal can be increased.

(2) In the connector with the configuration of the above (1), the distal end is folded inside the other inner wall part.

According to the connector with the configuration of the above (2), the distal end of the terminal fitting buried in the other inner wall part is held tightly. Hence, a holding effect in one end of the terminal fitting in the case of being connected to the other terminal or the case of preventing an inward fall of the connector housing is improved.

(3) In the connector with the configuration of the above (1), the connector housing is formed in substantially a rectangular angular tube shape in which the one inner wall part and the other inner wall part are set at sides of long sides and the terminal fittings are equally spaced with each other along a long side of the connector housing.

According to the connector with the configuration of the above (3), in the connector housing formed in substantially the rectangular angular tube shape, one inner wall part and the other inner wall part in the sides of the long sides in which a long distance is not supported with respect to a short side are supported by one end of the terminal fitting joined and fixed between both of the inner wall parts, so that inward falls of one inner wall part and the other inner wall part in the sides of the long sides can be prevented even in the case of the flat connector housing with a high ratio (aspect ratio) between the short side and the long side.

(4) In the connector with the configuration of above (1), the outside of the connector housing is covered with a shield shell.

According to the connector with the configuration of the above (4), a good shield connector for preventing an inward fall of the connector housing can be constructed.

According to the invention, the good connector capable of preventing the inward fall of the connector housing formed in the tubular shape can be provided.

The invention has been described above briefly. Further, the details of the invention will become more apparent by reading through a mode (hereinafter called an "embodiment") for carrying out the invention described below with reference to the accompanying drawings.

DETAILED DESCRIPTION OF THE EXEMPLARY EMBODIMENTS

An embodiment according to the invention will hereinafter be described with reference to the drawings.

A connector according to the present embodiment can suitably be adopted in, for example, a shield connector attached to an electric wire 11 with a shield connector. In addition, the connector of the invention can be applied to any connector as long as a terminal fitting is formed inside a tubular connector housing by insert molding.

The electric wire 11 with the shield connector of the embodiment is used in, for example, the case where an upper side connector (connector) 17 connected to a motor through electric wires 15 is attached to a shield case of an inverter in, for example, an electric vehicle.

Figure 1:
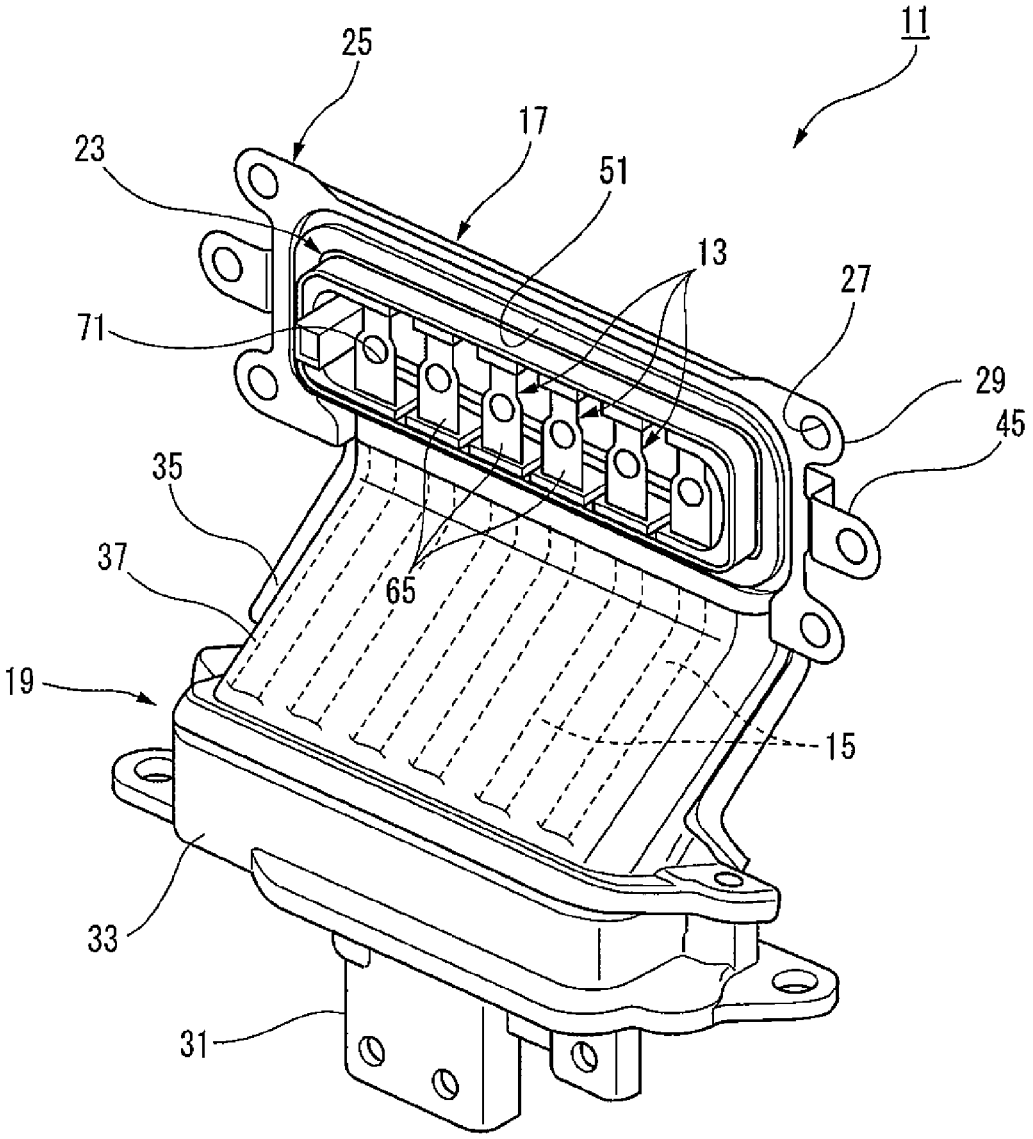
FIG. 1 is a perspective view of an electric wire with a shield connector including a connector according to one embodiment of the invention.
Figure 3:
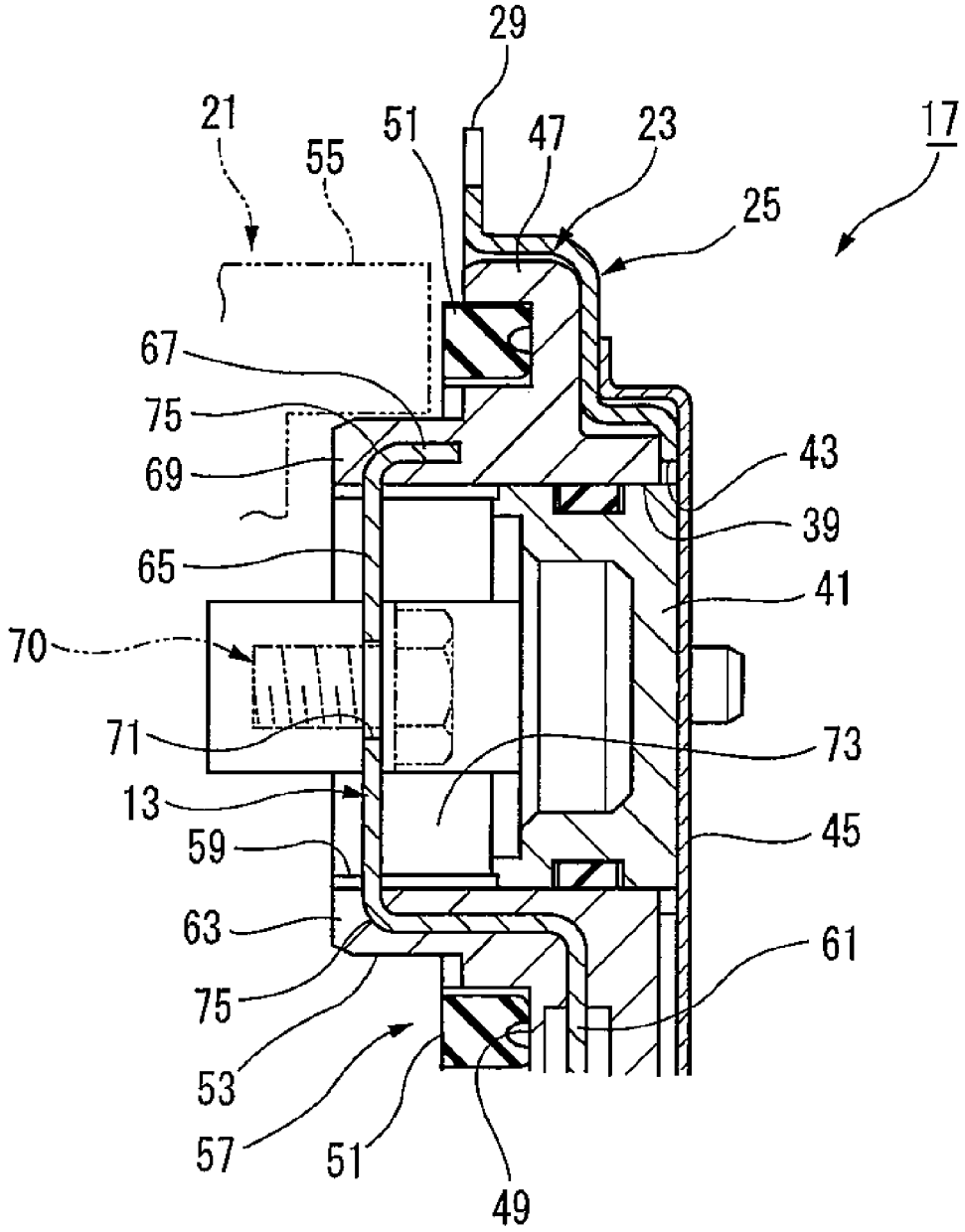
FIG. 3 is a sectional view taken on line D-D of FIG. 2.
Figure 4:
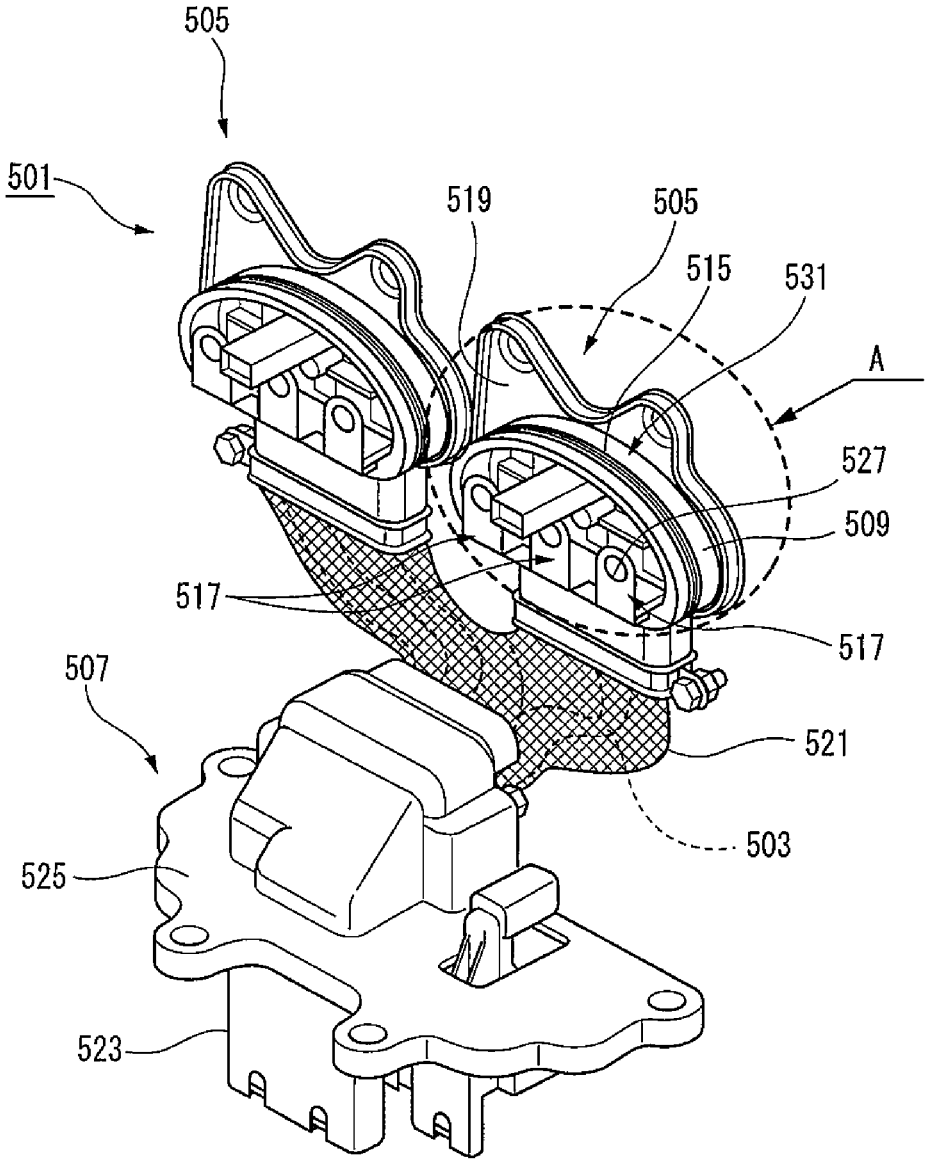
FIG. 4 (Prior Art)
FIG. 4 is a perspective view of a conventional electric wire with a shield connector.
Figure 5:
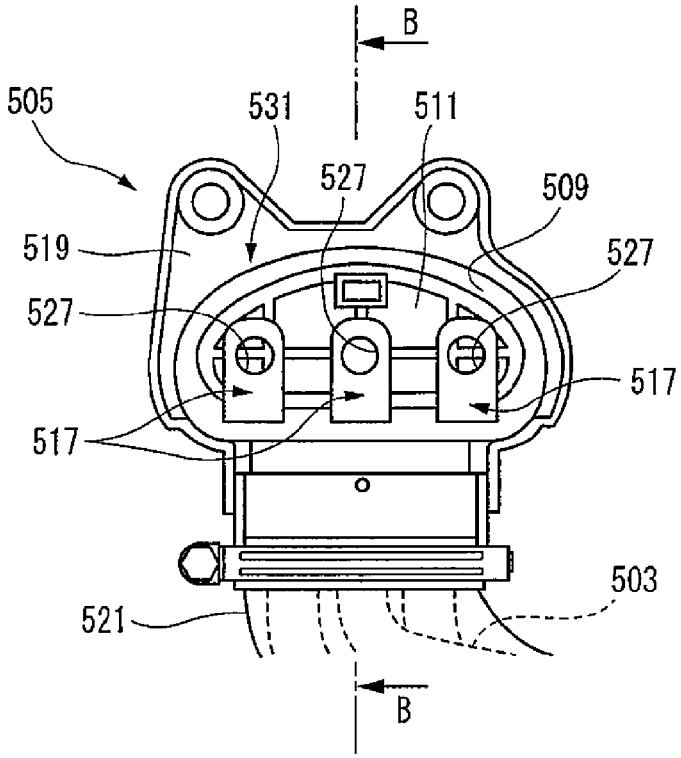
FIG. 5 (Prior Art)
FIG. 5 is an enlarged front view of part A of FIG. 4.

As shown in FIG. 1, in the electric wire 11 with the shield connector, the upper side connector 17 is attached to one ends of the electric wires 15 and a lower side connector 19 is attached to the other ends of the electric wires 15. The other connector 21 (see FIG. 3) of the motor side is connected to the upper side connector 17, and the inverter is connected to the lower side connector 19 which is a shield connector.

The upper side connector 17 according to the embodiment includes an upper side housing (connector housing) 23 formed in a tubular shape by an insulating synthetic resin, a cover 41 for closing an opening 39 of one end side (right side in FIG. 3) in an axial direction of the upper side housing 23, plural bus bars (terminal fittings) 13 formed inside the upper side housing 23 by insert molding, the bus bar 13 in which one end 65 is arranged in an opening 59 for coupling of the other end side (left side in FIG. 3) in the axial direction of the upper side housing 23 and also the other end 61 is connected to one end of the electric wire 15, and an upper side shield shell (shield shell) 25 with which the outside of the upper side housing 23 is covered.

In addition, the terminal fitting in the embodiment is configured as the bus bar 13 formed integrally to a band plate-shaped conductor of the electric wire 15, but can also be configured to connect a separate flat plate-shaped terminal fitting to the conductor of the electric wire.

The outside of the upper side housing 23 is covered with the upper side shield shell 25. The upper side shield shell 25 is integrally provided with an earth terminal 29 having a hole 27 of attachment to the other connector 21.

The lower side connector 19 has a lower side housing 31. The outside of the lower side connector 19 is covered with a lower side shield shell 33. The plural electric wires 15 for making between the upper side connector 17 and the lower side connector 19 are covered with an upper side shield cover 35 and a lower side shield cover 37 made of conductive metal whose external shape is formed in a flat tubular shape.

The upper end of the upper side shield cover 35 is secured to the upper side shield shell 25 of the upper side connector 17, and the lower end of the upper side shield cover 35 is formed in a free end. The lower end of the lower side shield cover 37 is secured to the lower side shield shell 33 of the lower side connector 19, and the upper end of the lower side shield cover 37 is formed in a free end. Then, the free end which is the lower end of the upper side shield cover 35 is mutually butted against or mutually lapped over the free end which is the upper end of the lower side shield cover 37. Accordingly, shielding properties between the free ends are ensured in the upper side shield cover 35 and the lower side shield cover 37 divided vertically. In addition, the upper side shield cover 35 and the lower side shield cover 37 are constructed by combination of two half tubular bodies in which respective side edges are mutually lapped in consideration of assembling capability.

The opening 39 of one end side in the axial direction of the upper side housing 23 is an opening for fastening work in which the other terminal (not shown) of the other connector 21 inserted from the opening 59 for coupling of the other end side in the axial direction is fastened to one end 65 of the bus bar 13 by a bolt 70. The opening 39 is closed by the cover 41 after the completion of fastening work. A cover hole 43 for avoiding this cover 41 is formed in the upper side shield shell 25. Further, the cover hole 43 is covered with a bracket 45 attached to the back outside of the upper side shield shell 25.

A flange 47 is formed on an outer periphery of the upper side housing 23, and an annular groove 49 is formed in a surface of the fitting side of the other connector of the flange 47. In the upper side housing 23, annular packing 51 which is a sealing member is fitted and mounted into this annular groove 49. When a fitting part 55 of the other connector 21 is externally inserted into an outer peripheral surface of the upper side housing 23, the distal end of the fitting part 55 abuts on the packing 51. In the upper side connector 17, a gap between the upper side housing 23 and the fitting part 55 of the other connector 21 is watertightly sealed with the packing 51 constructing a sealing part 57.

In the upper side housing 23, the other end side in the axial direction forms the opening 59 for coupling to the other connector 21. One end 65 of the bus bar 13 is arranged in this opening 59 for coupling.

One end 65 of the bus bar 13 is led out of one inner wall part (inner wall part of the lower side in the drawing) 63 of the upper side housing 23 and traverses the opening 59 for coupling from the lower side to the upper side and also, a distal end 67 is buried in the other inner wall part 69 opposed to one inner wall part 63. Further, the distal end 67 is folded inside the other inner wall part 69.

That is, one end 65 of the bus bar 13 is folded and formed in a U-shaped cross section in a pair of parallel linear folded parts 75 extending in a width direction separately in a longitudinal direction, and the other end 61 and the distal end 67 are formed in one inner wall part 63 and the other inner wall part 69 by insert molding.

In order to make connection to a terminal of the other connector 21, a fastening hole 71 into which a bolt 70 is inserted is bored in one end 65 of the bus bar 13. The back of one end 65 is provided with space 73 for fastening the bolt 70. This space 73 is opened by detaching the cover 41.

Figure 2:
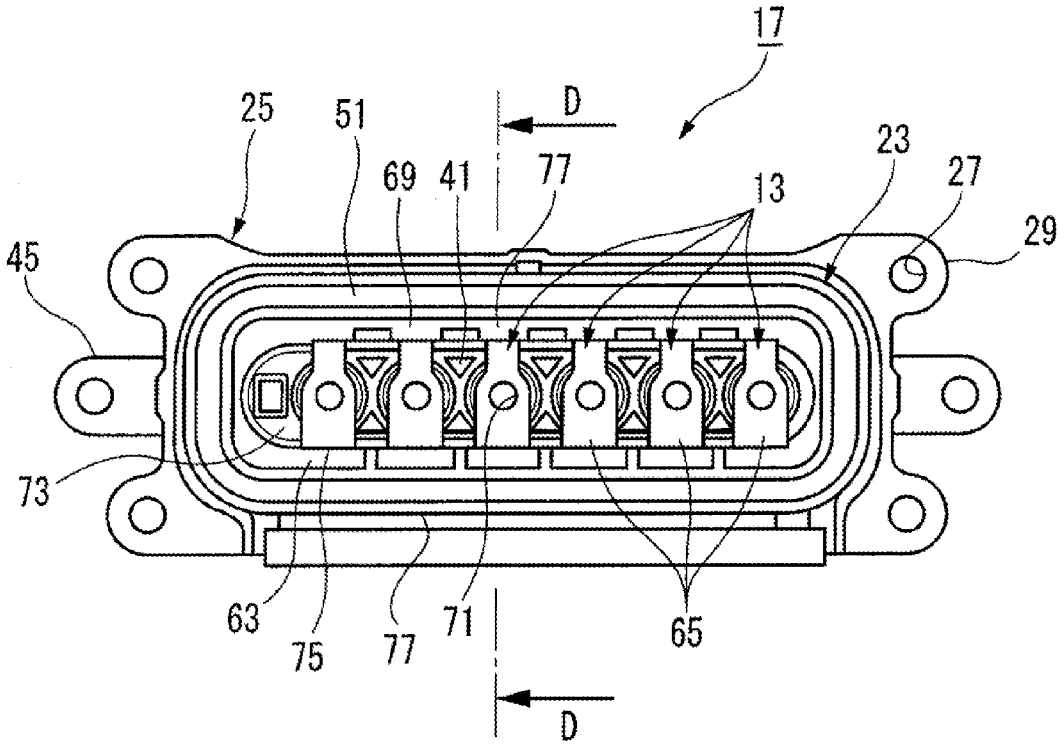
FIG. 2 is an enlarged front view of an upper side connector shown in FIG. 1.

As shown in FIG. 2, the upper side housing 23 of the embodiment is formed in substantially a rectangular angular tube shape in which one inner wall part 63 and the other inner wall part 69 are set at the sides of long sides. Then, inside the upper side housing 23, one ends 65 of the plural (six in the embodiment) bus bars 13 formed by insert molding are equally spaced along a long side 77 of substantially the rectangular angular tube shape.

Next, action of the upper side connector 17 having the above configuration will be described.

In the upper side connector 17, the other end 61 of the bus bar 13 is buried in one inner wall part 63 of the upper side housing 23 molded by a synthetic resin. One end 65 led out of this one inner wall part 63 and continuous with the other end 61 traverses the opening 59 for coupling. Further, the distal end 67 continuous with this one end 65 is buried inside the other inner wall part 69 opposed to one inner wall part 63.

Figure 6:
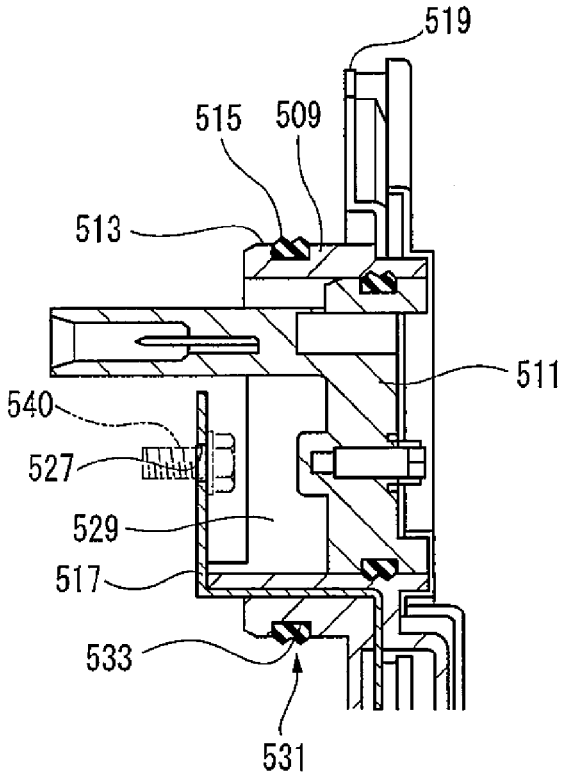
FIG. 6 (Prior Art)
FIG. 6 is a sectional view taken on line B-B of FIG. 5.

That is, according to the upper side connector 17 of the embodiment, one inner wall part 63 and the other inner wall part 69 facing each other across the opening 59 for coupling of the upper side housing 23 formed in substantially the rectangular angular tube shape are joined and fixed by one end 65 of the bus bar 13 formed by insert molding. Hence, in the upper side housing 23, an inward fall at the time of fitting the fitting part 55 of the other connector 21 or an inward fall due to contraction of a molded resin at the time of housing molding is prevented. Also, one end 65 of the bus bar 13 connected to the other terminal of the other connector 21 is in a support state of both ends supported by one inner wall part 63 and the other inner wall part 69 where one inner wall part 63 and the other inner wall part 69 face each other across the opening 59, so that strength of connection to the other terminal can be increased as compared with a conventional bus bar 517 (see FIG. 6) in a support state of one end.

Also, the distal end 67 in one end 65 of the bus bar 13 is folded inside the other inner wall part 69, so that the distal end 67 of the bus bar 13 buried in the other inner wall part 69 is held tightly. Hence, a holding effect in one end 65 of the bus bar 13 in the case of being connected to the other terminal or the case of preventing an inward fall of the upper side housing 23 is improved.

Further, according to the upper side connector 17 of the embodiment, in the upper side housing 23 formed in substantially the rectangular angular tube shape, one inner wall part 63 and the other inner wall part 69 in the sides of the long sides in which a long distance is not supported with respect to a short side are supported by one end 65 of the bus bar 13 joined and fixed between both of the inner wall parts. Hence, the upper side housing 23 is a flat connector housing with a high ratio (aspect ratio) between the short side and the long side, but inward falls of one inner wall part 63 and the other inner wall part 69 in the sides of the long sides are prevented surely.

Consequently, according to the upper side connector 17 according to the embodiment, an inward fall of the upper side housing 23 formed in substantially the rectangular angular tube shape can be prevented.

In addition, the present invention is not limited to the above-described embodiments, and modifications and improvements thereof may be appropriately made. Besides, the material, shape, dimensions, number, arrangement spots, and the like of each element in the above-described embodiments are arbitrary and are not limited as long as the present invention is able to be achieved.

The present invention is useful for providing a connector capable of preventing an inward fall of a connector housing formed in a tubular shape.

What is claimed is:

1. A connector comprising:

a connector housing formed in a tubular shape by an insulating synthetic resin;

a cover for closing an opening of one end side in an axial direction of the connector housing; and plural terminal fittings formed inside the connector housing by insert molding, one end of the terminal fittings each being arranged in an opening for coupling of the other end side in the axial direction of the connector housing and the other end of the terminal fittings each being connected to one end of an electric wire, wherein the one end of the terminal fittings each led out of one inner wall part of the connector housing traverses the opening for coupling, and a distal end of the terminal fittings each is buried in the other inner wall part opposed to the one inner wall part, and wherein a portion of the one end of each of the terminal fittings which is buried in the one inner wall part and a portion of the distal end of each of the terminal fittings which is buried in the other inner wall part are folded to form a U-shaped cross section of each of the terminal fittings.

2. The connector as set forth in claim 1, wherein the connector housing is formed in substantially a rectangular angular tube shape in which the one inner wall part and the other inner wall part are set at sides of long sides and the terminal fittings are equally spaced with each other along a long side of the connector housing.

3. The connector as set forth in claim 1, wherein the outside of the connector housing is covered with a shield shell.

4. The connector as set forth in claim 1, wherein the portion of the one end of each of the terminal fittings which is buried in the one inner wall part and the portion of the distal end of each of the terminal fittings which is buried in the other inner wall part which are folded are located linear and parallel to each other.

* * * * *